US005286075A

United States Patent [19]

Monzingo

[11] Patent Number: 5,286,075

[45] Date of Patent: Feb. 15, 1994

[54] DOOR SECURITY DEVICE

[76] Inventor: Mathew Z. Monzingo, 2625 Sunset Dr., Vernon, Tex. 76384

[21] Appl. No.: 997,034

[22] Filed: Dec. 28, 1992

[51] Int. Cl.[5] ..... E05C 17/30

[52] U.S. Cl. ..... 292/339

[58] Field of Search ..... 292/336, 339, 262, DIG. 15

[56] References Cited

U.S. PATENT DOCUMENTS

| | | | |
|---|---|---|---|
| D. 255,212 | 6/1980 | Weigand et al. | 292/339 X |
| 4,300,796 | 11/1981 | Lane | 292/339 |
| 4,483,558 | 11/1984 | Van Meter | 292/339 |
| 4,563,027 | 1/1986 | Checkovsky et al. | 292/339 |
| 5,064,232 | 11/1991 | Quarberg | 292/339 |

FOREIGN PATENT DOCUMENTS

| | | | |
|---|---|---|---|
| 2102495A | 2/1983 | United Kingdom | 292/339 |

*Primary Examiner*—Richard E. Moore

*Attorney, Agent, or Firm*—Michael I. Kroll

[57] ABSTRACT

An improved door security device is for a door having a doorknob which consists of an elongated leg brace. A base is located on a lower end of the leg brace for frictional engagement upon a floor. A structure is located on an upper end of the leg brace for engaging the doorknob on the door, so as to prevent an unauthorized opening of the door.

11 Claims, 2 Drawing Sheets

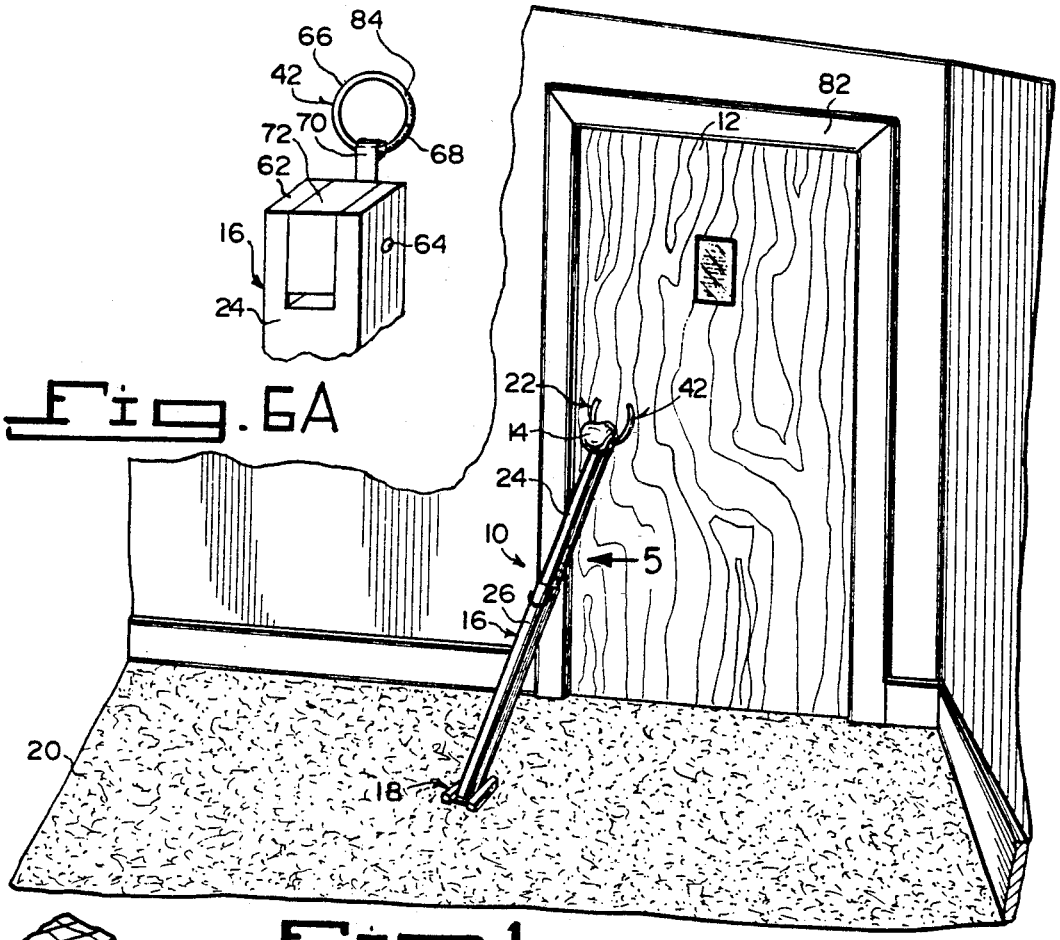
Fig. 6A
Fig. 1
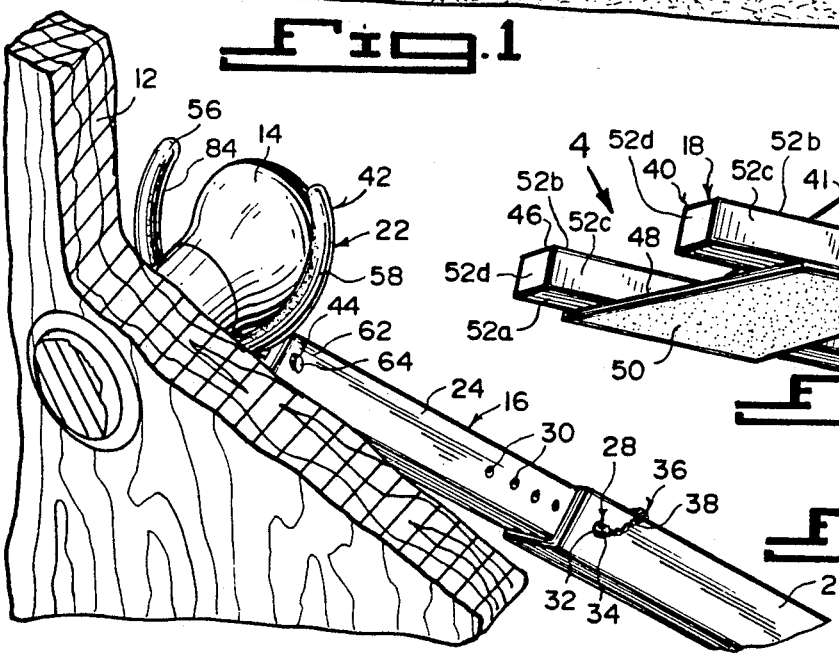
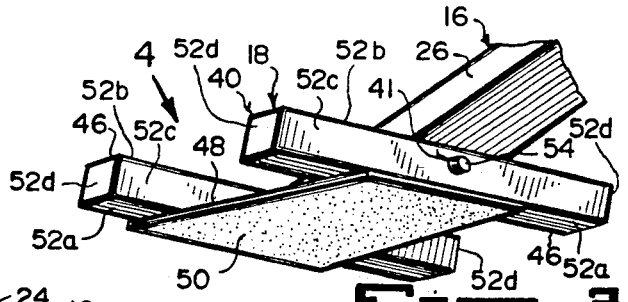
Fig. 3
Fig. 2

Fig. 4
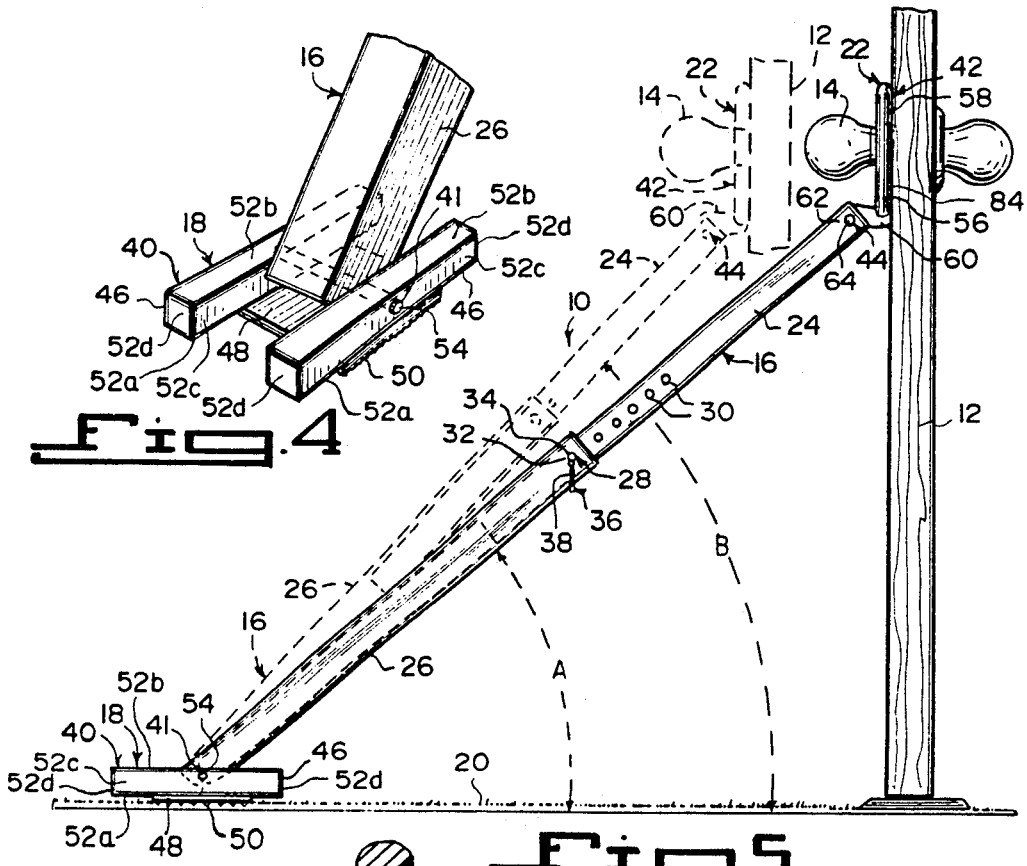
Fig. 5
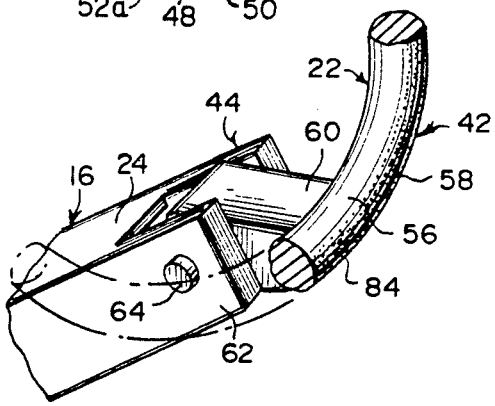
Fig. 6
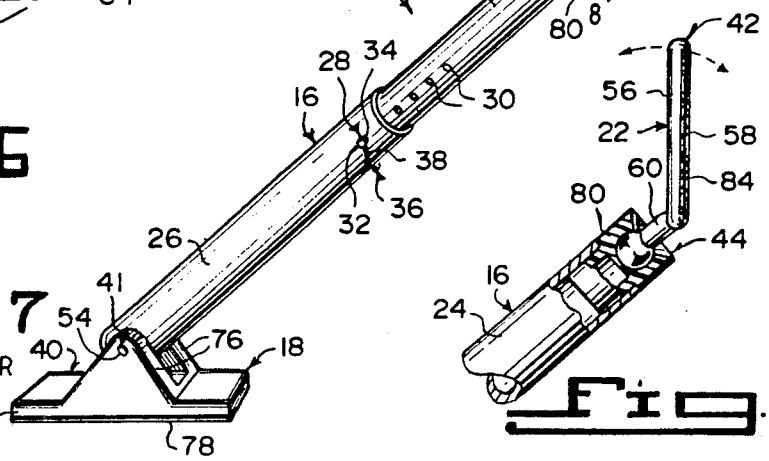
Fig. 7
(ALTERNATIVE TUBULAR EMBODIMENT)
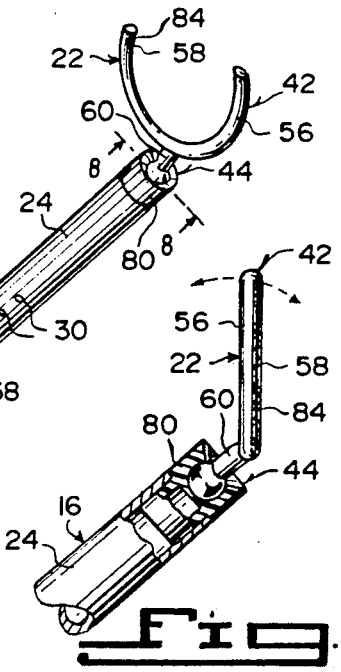
Fig. 8

DOOR SECURITY DEVICE

BACKGROUND OF THE INVENTION

1. Field of the Invention

The instant invention relates generally to door holders and more specifically it relates to an improved door security device.

2. Description of the Prior Art

Numerous door holders have been provided in prior art that are adapted to keep doors in closed positions and prevent the doors from being opened by unauthorized individuals. While these units may be suitable for the particular purpose to which they address, they would not be as suitable for the purposes of the present invention as heretofore described.

SUMMARY OF THE INVENTION

A primary object of the present invention is to provide an improved door security device that will overcome the shortcomings of the prior art devices.

Another object is to provide an improved door security device that can be quickly installed at an angle between a doorknob of a door and a floor to prevent an unwanted intrusion by an unauthorized person.

An additional object is to provide an improved door security device that ca be assembled and adjusted to almost any sized door to promote a feeling of security against an intruder break-in.

A further object is to provide an improved door security device that is simple and easy to use.

A still further object is to provide an improved door security device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of a first embodiment of the instant invention installed in place against a door.

FIG. 2 is a rear perspective view thereof with parts broken away showing the first embodiment in engagement with the doorknob.

FIG. 3 is a bottom perspective view with parts broken away of the frictional floor engagement base in greater detail.

FIG. 4 is a top perspective view taken in direction of arrow 4 in FIG. 3.

FIG. 5 is a side view taken in direction of arrow 5 in FIG. 1.

FIG. 6 is an enlarged perspective view with parts broken away showing the doorknob engaging structure in greater detail.

FIG. 6A is a perspective view of another type of doorknob engaging structure.

FIG. 7 is a perspective view of a second embodiment of the instant invention having an alternative tubular construction.

FIG. 8 is a partial cross sectional view taken along line 8—8 in FIG. 7, showing the ball and socket universal joint for the doorknob engaging structure in greater detail.

DETAILED DESCRIPTION OF THE PREFERRED EMBODIMENTS

Turning now descriptively to the drawings, in which similar reference characters denote similar elements throughout the several views, the Figures illustrate an improved door security device 10 for a door 12 having a doorknob 14. The device 10 consists of an elongated leg brace 16, a base 18 located on a lower end of the leg brace 16 for frictional engagement upon a floor 20 and a structure 22 located on an upper end of the leg brace 16 for engaging the doorknob 14 on the door 12, so as to prevent an unauthorized opening of the door 12.

The leg brace 16 includes two telescopic sections 24, 26, in which the upper section 24 slides into the lower section 26. An apparatus 28 is for securing the two telescopic sections 24, 26 in extended and retracted positions, so as to make the leg brace 16 adjustable with respect to the location of the doorknob 14 on the door 12 and the distance of the doorknob 14 from the floor 20 (see FIG. 5).

The securing apparatus 28 consists of the upper section 24 of the leg brace 16 having a plurality of spaced apart transverse holes 30 therethrough at its bottom end. The lower section 26 of the leg brace 16 has a transverse hole 32 therethrough at its top end. A retainer pin 34 fits through the transverse hole 32 in the lower section 26 of the leg brace 16 and any one of the transverse holes 30 in the upper section 24 of the leg brace 16.

A flexible fastener 36 is for connecting one end of the retainer pin 34 to the top end of the lower section 26 of the leg brace 16 to prevent an accidental loss of the retainer pin 34 when removed therefrom. The flexible fastener 36 is a chain 38 extending between the one end of the retainer pin 34 and the top end of the lower section 26 of the leg brace 16.

The base 18 includes a non-skid foot assembly 40 and a mechanism 41 for pivotally mounting the foot assembly 40 to the lower end of the lower section 26 of the leg brace 16. The doorknob engaging structure 22 includes a bracket 42 for contacting the doorknob 14 and a mechanism 44 for pivotally mounting the bracket 42 to the upper end of the upper section 24 of the leg brace 16.

As shown in FIGS. 1 through 6, the two telescopic sections 24, 26 of the leg brace 16 are square shaped tubing. The non-skid foot assembly 40 contains a pair of support members 46 to fit on opposite sides of the lower end of the lower section 26 of the leg brace 16. A plate 48 is affixed to and extends between the underside of the support members 46. A non-skid surface 50 is located at the underside of the plate 48 to make contact with the floor 20.

Each support member 46 is a rectangular piece of square tubing and includes a rectangular shaped bottom wall **52*a*, a rectangular shaped top wall 52*b*, a pair of rectangular shaped side walls 52*c* and a pair of square shaped end walls 52*d***.

The foot assembly pivotally mounting mechanism 41 is a pivot pin 54 which extends through the center of the side walls **52*c* of the support members 46 and the lower end of the lower section 26 of the leg brace 16. The bracket 42 includes a C-shaped member 56 having a non-skid surface 58 to make contact with the doorknob 14 and an arm 60 extending from the center of the C-shaped member 56**.

The bracket pivotally mounting mechanism 44 includes the upper end of the upper section 24 of the leg brace 16 having a fork 62 thereon, so that a lower end of the arm 60 can fit into the fork 62. A second pivot pin 64 extends through the fork 62 and the lower end of the arm 60.

The bracket 42, as shown in FIG. 6A, can consist of an O-shaped member 66 having a non-skid surface 68 to make contact with the doorknob 14. An arm 70 extends from the O-shaped member 66, while a square shaped plug 72 is affixed to an opposite end of the arm 70. The square shaped plug 72 can now fit into the fork 62, while the second pivot pin 64 extends through the fork 62 and the square shaped plug 72.

In FIGS. 7 and 8, the two telescopic sections 2 26 of the leg brace 16 are cylindrical shaped tubing. The non-skid foot assembly 40 includes a plate 74 having a pair of furcations 76 extending upwardly, so that the lower end of the lower section 26 of the leg brace 16 can fit between the furcations 76. A non-skid surface 78 is located at the underside of the plate 74 to make contact with the floor 20. The pivot pin 54 extends through the furcations 76 and the lower end of the lower section 26 of the leg brace 16.

The bracket 42 consists of the same C-shaped member 56 having the non-skid surface 58 to make contact with the doorknob 14. The arm 60 also extends from the center of the C-shaped member 56. The bracket pivotally mounting mechanism 44 now includes a ball and socket universal joint 80 between the upper end of the upper section 24 of the leg brace 16 and the arm 60.

The improved door security device 10 can force the door 12 upward against the door jamb 82. This forms another obstacle, when an intruder attempts entry, by making it harder to open the door 12. The doorknob engaging structure 22 accomplishes this by pushing upward against the doorknob 14, thus forcing the door 12 upward while preventing the doorknob 14 from turning. The bracket 42 keeps the improved door security device 10 in place on the doorknob 14 and does not allow the intruder to knock it out of the way or dislodge it from placement. The bracket 42 can be coated on the non-skid surface 58/68 with a rubberized or plastic coating 84, to prevent scratching of the doorknob 14 and any surface of the door 12.

LIST OF REFERENCE NUMBERS

10 improved door security device
12 door
14 doorknob
16 leg brace
18 base
20 floor
22 doorknob engaging structure
24 upper section of 16
26 lower section of 16
28 securing apparatus
30 transverse hole in 24
32 transverse hole in 26
34 retainer pin
36 flexible fastener for 26 and 34
38 chain for 36
40 non-skid foot assembly for 18
41 pivotally mounting mechanism for 40
42 bracket
44 pivotally mounting mechanism for 42
46 support member
48 plate
50 non-skid surface on 48
**52*a* rectangular shaped bottom wall of 46**
**52*b* rectangular shaped top wall of 46**
**52*c* rectangular shaped side wall of 46**
**52*d* square shaped end wall of 46**
54 first pivot pin
56 C-shaped member
58 non-skid surface on 56
60 arm extending from 56
62 fork on 24
64 second pivot pin
66 O-shaped member
68 non-skid surface on 66
70 arm extending from 66
72 square shaped plug
74 plate
76 furcation on 74
78 non-skid surface on 74
80 ball and socket universal joint for 44
82 door jamb
84 rubberized or plastic coating on 58/68

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved door security device for a door having a doorknob which comprises:

a) an elongated leg brace;

b) means located on a lower end of said leg brace for frictional engagement upon a floor; and c) means located on an upper end of said leg brace for engaging the doorknob on the door, so as to prevent an unauthorized opening of the door, wherein said leg brace includes:

a) two telescopic sections, in which said upper section slides into said lower sections;

b) means for securing said two telescopic sections in extended and retracted positions, so as to make said leg brace adjustable with respect to the location of the doorknob on the door and the distance of the doorknob from the floor, wherein said securing means includes:

a) said upper section of said leg brace having a plurality of spaced apart transverse holes therethrough at its bottom end;

b) said lower section of said leg brace having a transverse hole therethrough at its top end; and c) a retainer pin to fit through said transverse hole in said lower section of said leg brace and any one of said transverse holes in said upper section of said leg brace, wherein said securing means further includes a flexible fastener for connecting one end of said retainer pin to the top end of said lower section of said leg brace to prevent an accidental loss of said retainer pin when removed therefrom, wherein said flexible fastener means is a chain extending between the one end of said retainer pin and the top end of said lower section of said leg brace, wherein said frictional floor engagement means includes:

a) a non-skid foot assembly; and b) a means for pivotally mounting said foot assembly to said lower end of said lower section of said leg brace, wherein said doorknob engaging means includes:

a) a bracket for contacting said doorknob; and b) means for pivotally mounting said bracket to said upper end of said upper section of said leg brace wherein said two telescopic sections of said leg brace are square shaped tubing, wherein said non-skid foot assembly includes:

a) a pair of support members to fit on opposite sides of said lower end of said lower section of said leg brace;

b) a plate affixed to and extending between the underside of said support members; and c) a non-skid surface located at the underside of said plate to make contact with the floor wherein each said support member is a rectangular piece of square tubing and includes:

a) a rectangular shaped bottom wall;

b) a rectangular shaped top wall;

c) a pair of rectangular shaped side walls; and d) a pair of square shaped end walls.

2. An improved door security device as recited in claim 1, wherein said foot assembly pivotally mounting means is a pivot pin which extends through the center of said sidewalls of said support members and said lower end of said lower section of said leg brace.

3. An improved door security device as recited in claim 2, wherein said bracket includes:

a) a C-shaped member having a non-skid surface to make contact with said doorknob; and b) an arm extending from the center of said C-shaped member.

4. An improved door security device as recited in claim 3, wherein said bracket pivotally mounting means includes:

a) said upper end of said upper section of said leg brace having a fork thereon, so that a lower end of said arm can fit into said fork; and b) a second pivot pin which extends through said fork and said lower end of said arm.

5. An improved door security device as recited in claim 2, wherein said bracket includes:

a) an O-shaped member having a non-skid surface to make contact with said doorknob;

b) an arm extending from said O-shaped member; and c) a square shaped plug affixed to an opposite end of said arm.

6. An improved door security device as recited in claim 5, wherein said bracket pivotally mounting means includes:

a) said upper end of said upper section of said leg brace having a fork thereon, so that said square shaped plug can fit into said fork; and b) a second pivot pin which extends through said fork and said square shaped plug.

7. An improved door security device as recited in claim 1, wherein said two telescopic sections of said leg brace are cylindrical shaped tubing.

8. An improved door security device as recited in claim 7, wherein said non-skid foot assembly includes:

a) said plate having pair of furcations extending upwardly, so that said lower end of said lower section of said leg brace can fit between said furcations.

9. An improved door security device as recited in claim 8, wherein said foot assembly pivotally mounting means is a pivot pin which extends through said furcations and said lower end of said lower section of said leg brace.

10. An improved door security device for a door having a doorknob which comprises:

a) an elongated leg brace;

b) means located on a lower end of said leg brace for frictional engagement upon a floor; and c) means located on an upper end of said leg brace for engaging the doorknob on the door, so as to prevent an unauthorized opening of the door, wherein said leg brace includes:

a) two telescopic sections, in which said upper section slides into said lower section; and b) means for securing said two telescopic sections in extended and retracted positions, so as to make said leg brace adjustable with respect to the location of the doorknob on the door and the distance of the doorknob from the floor, wherein said securing means includes:

a) said upper section of said leg brace having a plurality of spaced apart transverse holes therethrough at its bottom end;

b) said lower section of said leg brace having a transverse hole therethrough at its top end; and c) a retainer pin to fit through said transverse hole in said lower section of said leg brace and any one of said transverse holes in said upper section of said leg brace, wherein said securing means further includes a flexible fastener for connecting one end of said retainer pin to the top end of said lower section of said leg brace to prevent an accidental loss of said retainer pin when removed therefrom, wherein said flexible fastener means is a chain extending between the one end of said retainer pin and the top end of said lower section of said leg brace, wherein said frictional floor engagement means includes:

a) a non-skid foot assembly; and b) a means for pivotally mounting said foot assembly to said lower end of said lower section of said leg brace, wherein said doorknob engaging means includes:

a) a bracket for contacting said door knob; and b) means for pivotally mounting said bracket to said upper end of said upper section of said leg brace, wherein said two telescopic sections of said leg brace are cylindrical shaped tubing, wherein said non-skid foot assembly includes:

a) a plate having a pair of furcations extending upwardly, so that said lower end of said lower section of said leg brace can fit between said furcations; and b) a non-skid surface located at the underside of said plate to make contact with the floor, wherein said foot assembly pivotally mounting means is a pivot pin which extends through said furcations and said lower end of said lower section of said leg brace, wherein said bracket includes:

a) a C-shaped member having a non-skid surface to make contact with said doorknob; and b) an arm extending from the center of said C-shaped member.

11. An improved door security device as recited in claim 10, wherein said bracket pivotally mounting means includes a ball and socket universal joint between said upper end of said upper section of said leg brace and said arm.

* * * * *